US005875592A

United States Patent [19]

Allman et al.

[11] Patent Number: 5,875,592

[45] Date of Patent: Mar. 2, 1999

[54] RETROFIT ROOF SUBFRAMING SUPPORT ASSEMBLY

[75] Inventors: Robert Allman, Moon Township; Richard Welton, Clinton, both of Pa.

[73] Assignee: Centria, Moon Township, Pa.

[21] Appl. No.: 880,279

[22] Filed: Jun. 23, 1997

[51] Int. Cl.[6] ..... E04B 7/02

[52] U.S. Cl. ..... 52/90.2; 52/58; 52/198; 52/640; 52/66

[58] Field of Search ..... 52/90.1, 90.2, 52/22, 66, 640, 749.12, 410, 440, 698, 58, 198, 299; 248/237, 351, 345, 189, 357

[56] References Cited

U.S. PATENT DOCUMENTS 5,603,187 2/1997 Merrin et al. ..... 52/90.2 X
5,704,170 1/1998 Simpson ..... 25/90.2 X

*Primary Examiner*—Lanna Mai
*Assistant Examiner*—W. Glenn Edwards
*Attorney, Agent, or Firm*—Buchanan Ingersoll, P.C.

[57] ABSTRACT

A retrofit roof riser subframing support assembly for attaching a new roof over an existing roof wherein the new roof has a slope independent of the slope of the existing roof. The assembly can include a series of spaced apart rows of roof support members having one end attachable to the new roof structure and another end mountable on the existing roof. Each row of roof support members can have a different height such that the difference in height between the tallest row and the shortest row defines the slope of the new roof. Each roof support member can include at least one fixed length post member having one end retained in a socket portion of a mounting member which is mountable on the existing roof. The other end of the post member can have a purlin clip rotatably connected thereto. The purlin clip can be rotated to the desired angle, locked in place, and attached to the new roof structure. The assembly can also include a sleeve member for connecting at least two fixed length post members together to form a roof support member having a desired height. All of the aforementioned components can be provided in kit form.

13 Claims, 5 Drawing Sheets

RETROFIT ROOF SUBFRAMING SUPPORT ASSEMBLY

BACKGROUND OF THE INVENTION

1. Field of the Invention

The invention relates to an apparatus for installing a new roof over an existing roof wherein the slope of the new roof can be independent of the slope of the existing roof. More particularly, the invention relates to a subframing support assembly for a new standing seam roof wherein the components are all standardized, pre-sized, and interchangeable in various combinations. Thus the builder can achieve the desired slope requirement for any roofing project without the need for field cutting any components.

2. Description of the Prior Art

One established method of erecting a new roof over an existing roof is to construct a support structure for the new roof on the existing roof. The lower part of the support structure is then attached to the existing roof structure. Next, the new roof structure is secured to the upper part of the support structure. The new roof structure generally consists of a number of roof panel members joined to each other and attached to underlying structural members commonly called "purlins." The purlins are what connects the new roof to the support structure.

Numerous types of new roof structures have heretofore been employed for buildings in efforts to provide a water tight roof assembly, while at the same time enabling the roof assembly to expand and contract as changes in temperature are encountered. Typical of such roof assemblies which have met with considerable success in recent years is the standing seam roof assembly. The panel members of a standing seam roof assembly are joined to each other along adjacent sides such that the sides are lapped together to form the standing seams. The panel members of the standing seam roof are then secured to structural members commonly referred to as "purlins". The interconnection of the panel members of the standing seam roof allow the roof structure to expand and contract as a function of the coefficient of expansion of the materials of which the roof panels are made and the temperature cycles to which the roof panels are exposed.

Standing seam roof assemblies are finding ever increasing usage in the "built-up" roof replacement segment of the roofing industry. Generally, a built-up roof is formed of a plurality of sections which are interconnected and overcoated with asphaltic composition to provide a water-tight seal. While such roof assemblies have generally served well, problems have nevertheless been encountered as a built-up roof ages, or when the building settles, or when the construction errors result in water standing in pockets on the roof assembly. This standing water can also result in deterioration of the roof causing leaks and the like to occur.

A need has long been recognized for a means for replacing such a built-up roof as well as other conventional roofs which does not require substantial modification of the pre-existing roof structure and which is economical in both fabrication and on-site construction. Further, it is highly desirable that the new roof assembly be capable of providing a new roof surface independent of the variations in the surface of the pre-existing roof assembly. Some past repair methods, especially those capable of altering the slope of the new roof to improve drainage characteristics, can require substantial destruction of the pre-existing roof and extensive custom construction. This can result in exposing the building and its contents to damage by the elements during the re-roofing process and can also be time consuming and expensive.

Some contemporary ways of providing a new roof on top of an existing roof are disclosed in U.S. Pat. Nos. 4,520,610 and 5,303,528, to Simpson, et. al. In each patent Simpson discloses a standing seam roof assembly and support apparatus for attaching a new roof on an existing roof which permits the slope of the new roof to be independent of the existing roof. In the '610 patent Simpson discloses using a series of adjustable truss members attached between the new roof and the existing roof. The height of the truss is adjustable so that the slope of the new roof can be set to the desired pitch by making the truss at the peak of the new roof a greater height than the truss at the lowest point of the new roof. Since the truss is adjustable, a series of identical trusses can be used with no field cutting of components required. The '528 patent additionally discloses a truss, or "elongated spanning member" supported by a series of independently vertically adjustable stanchions. The stanchions consist of interfitting longitudinally adjustable channel members which are lockable at variable heights. Thus, a series of spanning members supported by rows of vertically adjustable stanchions support the new roof on the existing roof at variable heights which can define the pitch of the new roof. Bearing plates are also disclosed between the stanchions and the existing roof. Also disclosed is that vertically adjustable members which have a lower member attachable to the existing roof and an upper member attachable to the new roof and including a web means which is pivotally connected to the upper or lower end so that it is also angularly adjustable with respect to the new roof. The upper member is attachable to a purlin clip for attaching the stanchion to a purlin which connects to the new roof. Additionally, the '528 patent discloses a Z-shaped roof support member consisting of two L-shaped member attached back to back in a Z-shape. Slots are provided in each so that the height may be adjusted vertically.

Another similar type of subframing assembly employs numerous rows of roof support members consisting of a base which attaches to the existing roof, a column member connected to the base, and a clip member affixed to the top of the column which attaches to a purlin for connection to the new roof. The column member and the base can be provided with a series of vertically spaced pre-drilled holes so that the height of the column can be adjusted to some extent by telescoping the end of the column in the base. The pre-drilled columns can be cut in various lengths to provide an initial overall height in addition to the vertical adjustment.

However, such field adjustable roof support assemblies can call for a multitude of system variations to accommodate particular job-to-job requirements. Some custom fabrication of the adjustable assembly for particular jobs can also be required prior to beginning construction. In addition, custom fabricated purlin clips for a particular pitch roof can be required.

Therefore, there is a need for a new roof subframing support assembly which is adaptable to virtually any retrofit roof application without the need for variations in the assembly system or custom fabrication or field cutting of any components. Moreover the new subframing support assembly should eliminate the need for custom fabricating the purlin clips for different pitch requirements.

SUMMARY OF THE INVENTION

In accordance with the present invention, there is provided a subframing support assembly for attaching a new roof on an existing roof wherein the new roof can have a slope independent of the existing roof. Further in accordance with the present invention such a roof subframing support assembly which requires neither variations in the assembly system for different job requirements nor customized fabrication or field cutting of any components in the assembly.

Such a subframing support assembly can include a plurality of individual roof support members which support the new roof structure on the existing roof. The roof support members can preferably be arranged in a series of spaced apart rows. Each row can consist of individual roof support members having a fixed height. Each row preferably can be successively shorter, or taller, such that the slope of the new roof is defined by the difference in height between the tallest row and the shortest row of roof support members.

Each roof support member can include at least one fixed length post member having one end connectable to a mounting member and the other end connectable to a purlin clip. The post member can be provided in a plurality of different lengths. The mounting member can include a base plate portion attachable to the existing roof and a socket portion adapted to receive one end of the post member and retain it therein. The purlin clip preferably can be rotatably connected to the other end of the post member and angularly adjustable to correspond to the desired slope of the new roof. Once rotated to the desired angle, the purlin clip can be locked in that position to receive the roof purlin system of the new roof. The purlin clip can preferably be provided in a number of different fixed lengths to provide an even greater range of adjustability in the overall height of the roof support member.

A sleeve member can also be provided to join together two or more post members end to end to form a taller roof support member. Consequently, the variety of different lengths of post members, purlin clips, and the provision of the sleeve member to join two or more post members together combine to create a large range of adjustability. The multipiplicity of possible different heights for the roof support members can provide a practically infinite number of pitch requirements without the need to field cut or otherwise customize any components while attaching the new roof.

Furthermore, each of the aforementioned components of a subframing support assembly described above can be provided in a single kit. Thus, a number of prefabricated, standardized components can be used to attach a new roof at a desired pitch height to an existing roof without the builder having to field cut any of the components.

Other details, objects, and advantages of the invention will become apparent from the following description and the accompanying drawings of certain presently preferred embodiments thereof.

BRIEF DESCRIPTION OF THE DRAWING FIGURES

In the accompanying drawing figures certain preferred embodiments of the invention are illustrated in which.

DETAILED DESCRIPTION OF CERTAIN EMBODIMENTS

Figure 1:
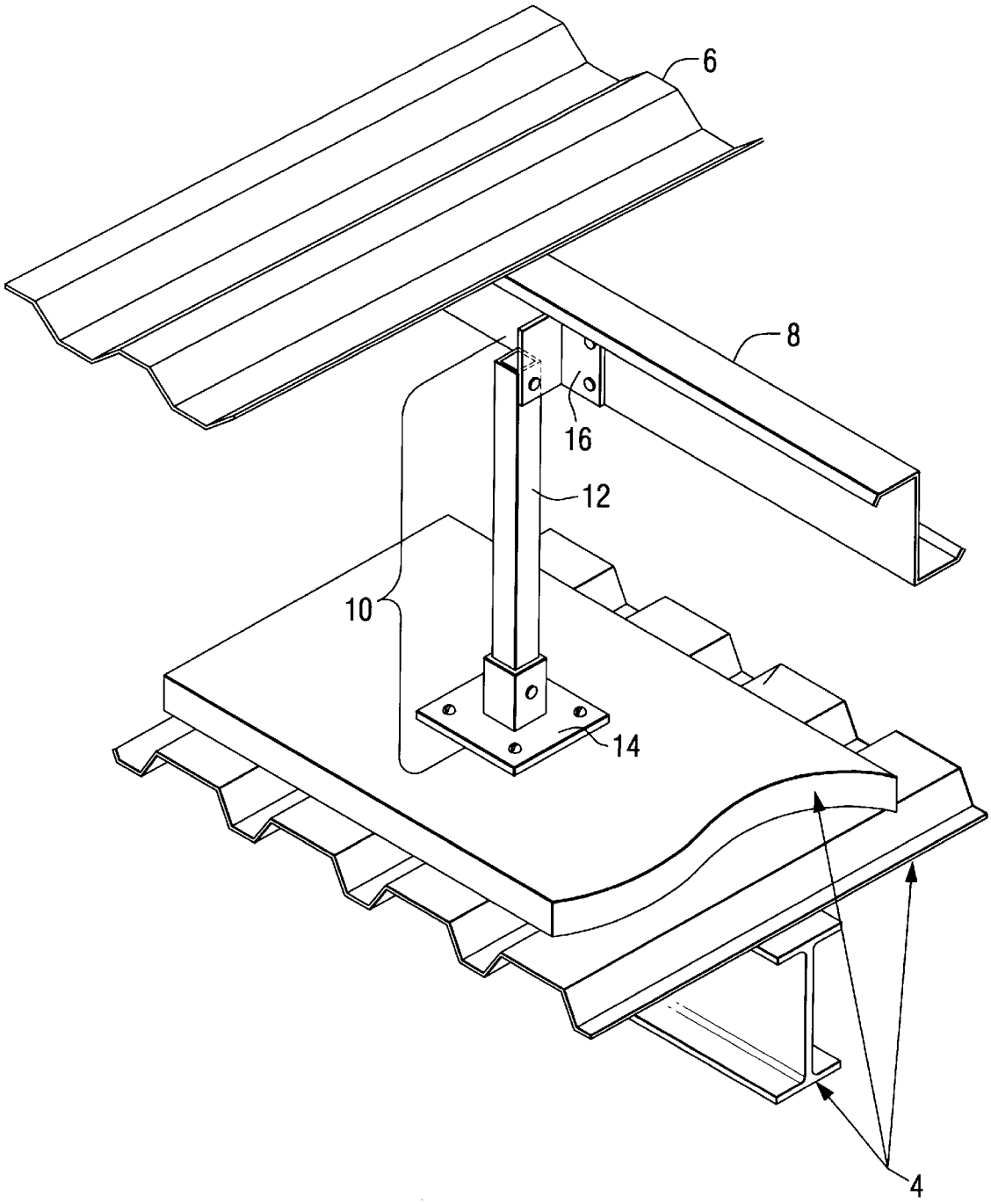
FIG. 1 is a perspective view illustrating a new roof installed over and existing roof using an embodiment of a subframing assembly according to the invention.
Figure 2:
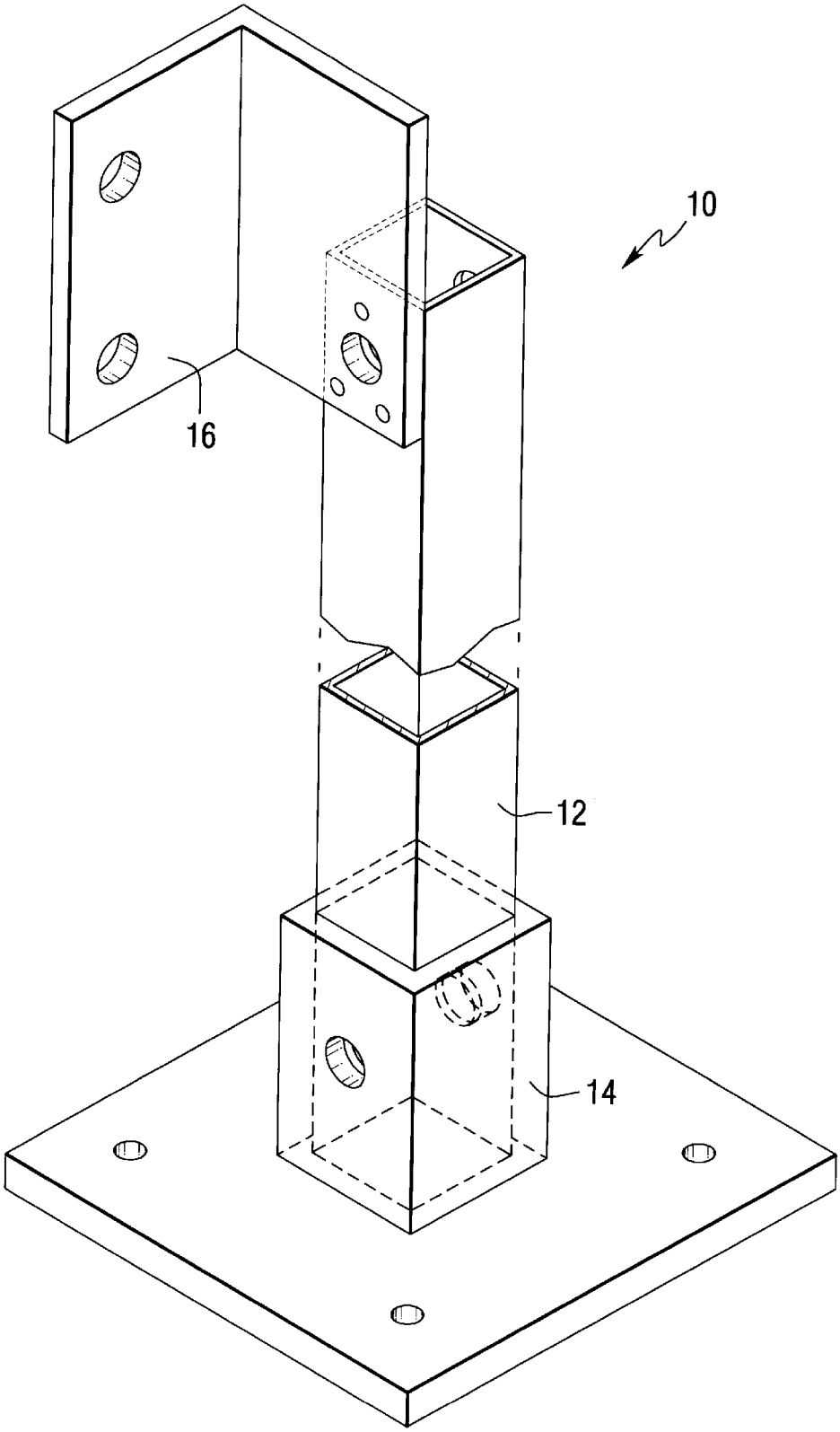
FIG. 2 is a perspective view of an embodiment of the invention.

Referring to the drawing figures, and particularly to FIGS. 1 and 2, there is illustrated a roof support member 10 of which a plurality thereof can be assembled to create a subframing support structure in the manner illustrated for attaching a new roof 6 and purlin 8 structure on top of an existing roof structure 4. The roof support member 10 can include a vertically oriented post member 12, a mounting member 14 connected to one end of the post member 12, and a purlin clip 16 rotatably connected to the other end of the post member 12.

The mounting member 14 can be attached to the existing roof for bearing the load of the new roof against the existing roof structure. The purlin clip 16 can be initially rotatably connected to the post member 12, but can be subsequently fixed in position once it is rotated to the desired angle. The purlin clip is attachable to the purlin 8 of the new roof structure 6.

Figure 3:
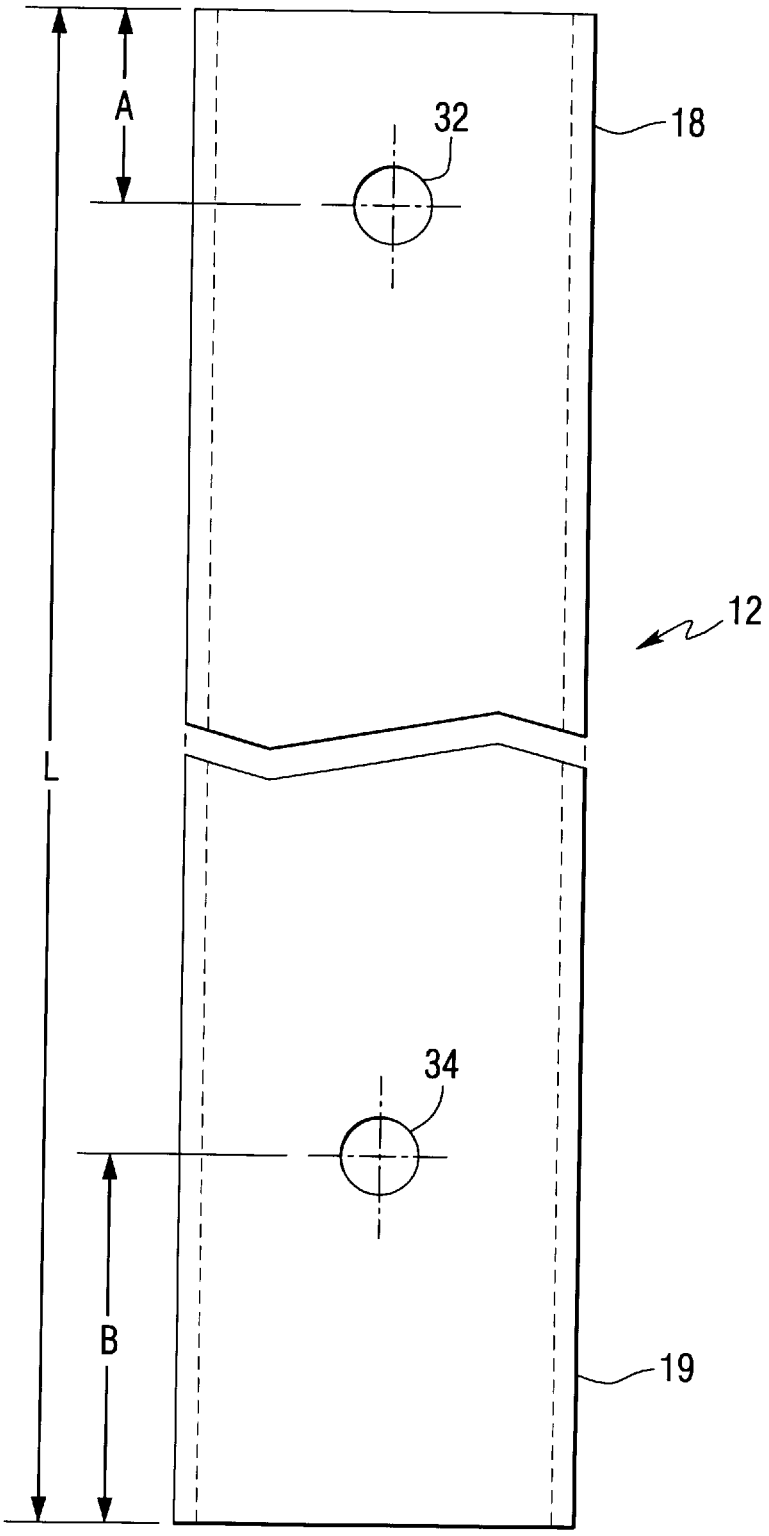
FIG. 3 is a side view of the post member shown in FIG. 1.

A post member 12 for at least partially supporting a new roof on top of an existing roof is illustrated in FIG. 3. The post member 12 has one end 18 connectable to the new roof and an opposite end 19 mountable on the existing roof. A plurality of such post members 12 can be provided in a variety of precut lengths "L" ranging, preferably, from about six inches to about six feet in increments of six inches. Several such post members 12 can be arrayed between the new roof and the existing roof in a number of spaced apart rows.

To provide the desired slope of the new roof, each row of roof support members 12 can consist of successively shorter length post members 12. A tallest row can preferably be located between the new roof and the existing roof near the highest point of the new roof, while the shortest row is preferably located between the existing roof and the new roof at the lowest point of the new roof. Each row of roof support members 10 positioned between the new roof and the existing roof has a height between the tallest row and the shortest row, depending on the relative position therebetween. Thus, the slope of the new roof is defined by the difference in height between the tallest row and the shortest row. Since precut post members 12 are available in six inch increments, the desired pitch of the new roof can be easily constructed without the necessity for field cutting, i.e., customizing, any of the post members 12.

In a certain embodiment, each post member 12 can be fabricated from square tube steel and can have a wall thickness of about 0.105 inch. Each end of the post member 18, 19 can have a through-hole 32, 34 predrilled through opposing sidewalls of the square tube. Preferably, dimensions A and B can both be about one inch. The through-holes 32, 34 are employed to attach the ends 18, 19 of the post member 12 to either the mounting base 14 or the purlin clip 16.

Figure 4:
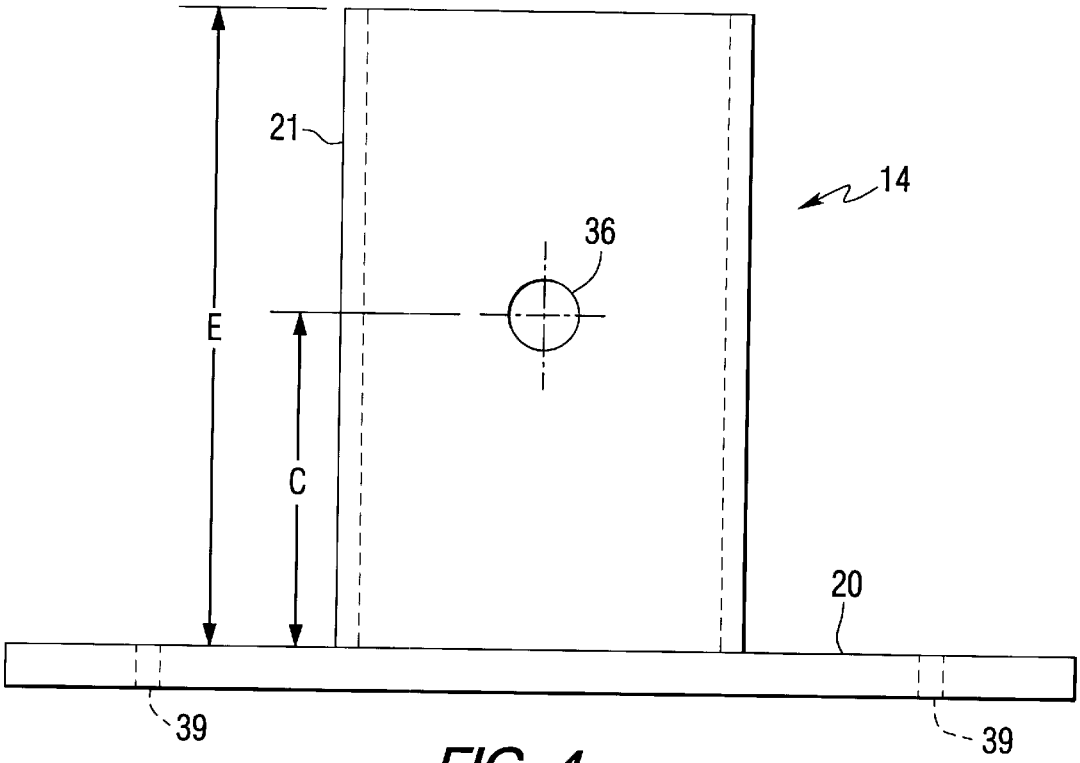
FIG. 4 is a side view of the mounting member shown in FIG. 1.

The mounting member 14, as shown in FIG. 4, can include a base plate portion 20 and a socket portion 21. The base plate 20 preferably has multiple apertures 39 for attaching the mounting member 14 on the existing roof. The socket portion 21 is adapted to receive an end of the post member 12 and retain it therein. A through-hole can be provided in the socket portion 21 to align with either of the through-holes 34, 36 in the ends 18, 19 of the post member 12.

In a certain embodiment of the base member 14 illustrated in FIG. 4, dimension "C" can be one inch. The socket portion 21 can be constructed of a square tube steel having a wall thickness of 0.105 inch and having an inside dimension sized to receive the square tube of which the post member 12 is constructed. The height "E" of the socket portion can be about three inches. The base plate portion 20 of the mounting member 14 is preferably square and the dimension of the sides "W" can be six inches. The thickness of the base plate portion 20 can be about 3/16 of an inch.

Figure 5:
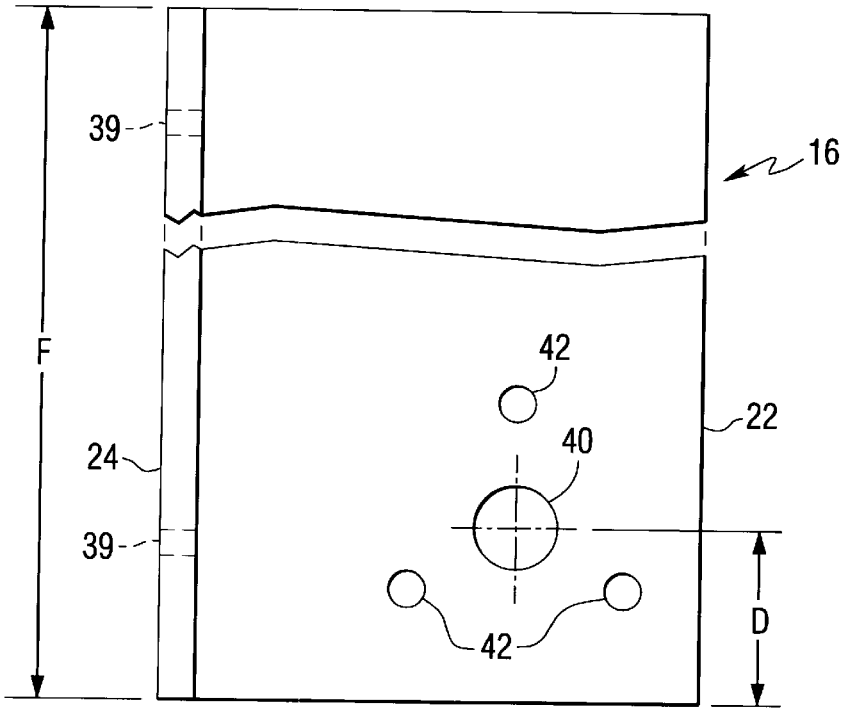
FIG. 5 is a side view of the purlin clip shown in FIG. 1.

Referring now to FIG. 5, the purlin clip 16 can be an L-shaped piece having sides 22 and 24. Side 22 can have a through-hole 40 provided therein which is rotatably connected to the post member 12 through either through-hole 32 or 34, depending on which end 18, 19 is used as the upper end of the roof support member 10. After the purlin clip 16 is connected to the post member 12 and rotated to the desired angle corresponding to the slope of the new roof, it can then be fixed in that position by installing fasteners through one or more predrilled apertures 42. The apertures 42 are preferably spaced out from the through-hole 40 and are also radially spaced apart from each other. Also, self-drilling screws can be used to lock the purlin clip 16 to the post member 12 at the desired angle. Once locked in the desired position the purlins 8 of the new roof 6 can be connected to the purlin clip 16 for securing the new roof 6 to the roof support members 10. One or more apertures 39 can be provided in the side 24 of the purlin clip 16 for attachment to the purlin 8. However, self drilling screws can also be used in which case the apertures 39 are not required.

In a certain embodiment, dimension "D" can be one inch and the purlin clip 16 can preferably be provided in seven precut lengths "F." The length "F" can preferably range from four inches to ten inches in one inch increments. Consequently, the height of the roof support member is adjustable in smaller increments in addition to the larger six inch increments in which the post members 12 are provided. The range of adjustability in the height of the roof support member 10 can generally eliminate any need for field cutting components during construction of the roof support assembly. Consequently, it is simpler and less expensive for the contractor to attach a new roof at the desired pitch.

Figure 6:
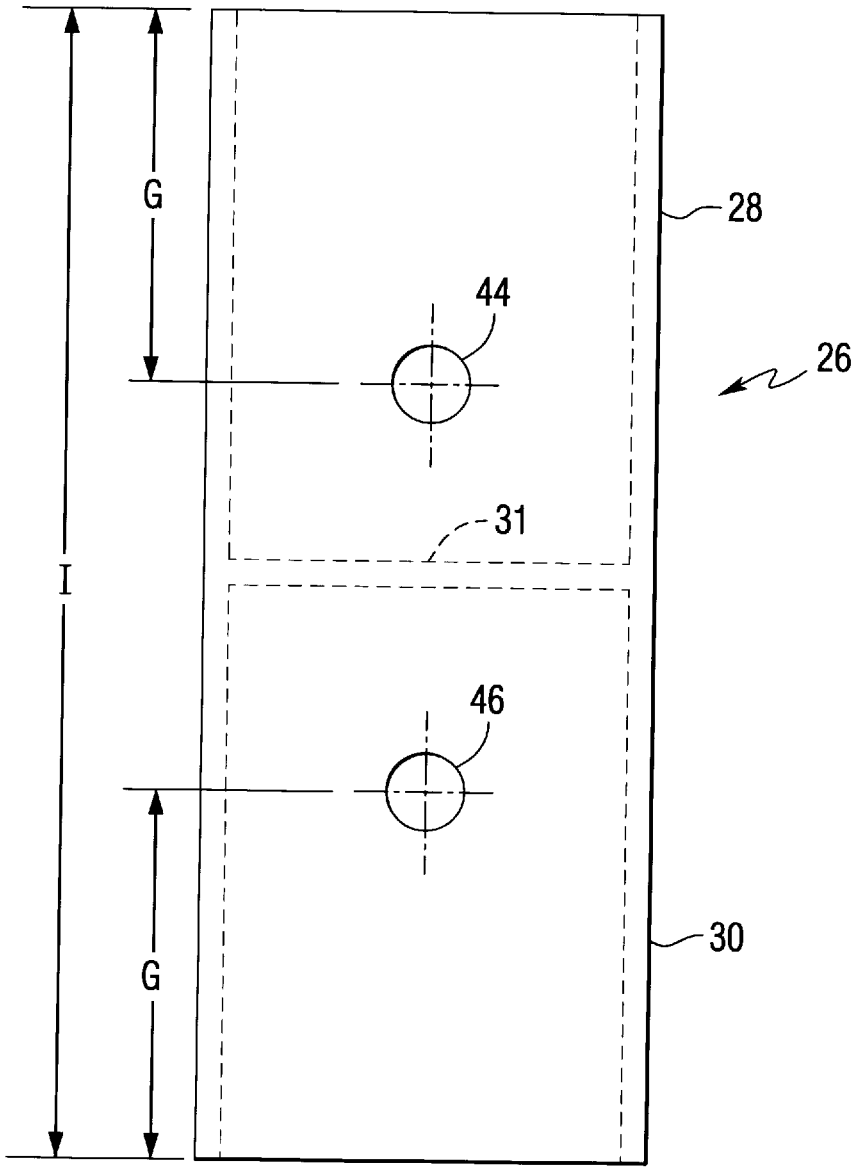
FIG. 6 is a side view of a sleeve member for joining two post members together.

A sleeve member 26, as shown in FIG. 6, can be provided for joining two post members 12 together end-to-end. The sleeve member preferably has two open ended portions 28 and 30 which are divided at the mid-point of the sleeve 26 by a dividing plate 31. Each end 28, 30 of the sleeve member 26 forms a socket adapted to receive one end of a post member 12 for joining the two post members 12 together to form a roof support member having a desired height. Consequently, if a height greater than the tallest post member 12 on hand is needed, two or more post members 12 can be connected together end to end without the necessity of field cutting the new component or obtaining additional components of the exact length desired. Thus, time and expense can be avoided during construction if unforeseen circumstances are encountered.

Preferably, two through-holes 44, 46 can be predrilled, one at either end 28 and 30, through the sidewalls of the sleeve member 26. The through-holes 44, 46 are preferably located to align with the through-hole 32, 34 at either end 18, 19 of the post member 12. A sleeve member can preferably be formed from square tube steel in a wall thickness of 0.105 inch and be dimensioned to receive one end of a post member 12. In a certain embodiment dimension "I" can be four inches and dimensions "G" and "H" can both be one inch, to correspond with dimensions "A" and "B", respectively, as shown in FIG. 3.

A roof support member according to the present invention and as described herein can preferably be provided in a kit form. Such a kit can include all of the components necessary to assemble a roof support structure comprised of an array of individual roof support members. The individual roof support members can be assembled in a broad range of heights to provide virtually any desired roof pitch.

Preferably, each post member is available in twelve different lengths ranging from six inches to six feet in six inch increments. In addition, the purlin clips can be furnished in seven different lengths ranging from four inches to ten inches in one inch increments. Including the mounting member and the sleeve member, a total of 21 different standard sized parts can be provided in kit form which can be combined to meet virtually any construction requirement. Consequently, in the case where the roof members are fabricated from 2 inch square tubing, each roof support member can generally have a range in height from a minimum of about 7 inches to a maximum practical height of about 150 inches. Although the potential maximum height is theoretically unlimited, since the sleeve members can be employed to join together an unlimited number of post members, practical considerations of structural integrity can impose certain limitations. Further limitations well known to those skilled in the construction arts can also be imposed depending on the weight of the new roof and the size and strength of the material from which the components are fabricated.

In addition to the providing the specified components, appropriate types and amounts of fasteners can also be included with the kit for connecting the components together and for attaching the assembled roof support members between the new and existing roof structures.

Although illustrated as having hollow square tube construction, it should be understood that round tubing or other shaped tubing, as well as solid tubing, could be utilized to fabricate the components of the roof support member described herein.

Furthermore, while certain embodiments of the invention have been described in detail, it will be appreciated by those skilled in the art that various modification to those details could be developed in light of the overall teaching of the disclosure. Accordingly, the particular embodiments disclosed herein are intended to be illustrative only and not limiting to the scope of the invention which should be awarded the full breadth of the following claims and any and all embodiments thereof.

What is claimed is:

1. A subframing support assembly for attaching a new roof structure over an existing roof wherein the new roof has a slope independent of the slope of the existing roof, said subframing assembly having a plurality of spaced apart rows of roof support members of decreasing height such that the slope of the new roof is defined by the difference between shortest and tallest rows of roof support members, each roof support member comprising:

a. at least one fixed length post member having one end attachable to the new roof structure and an opposite end mountable on the existing roof, said at least one post member available in a plurality of predetermined lengths;

b. a mounting member having a base plate portion attachable to the existing roof and a socket portion adapted to receive and retain therein one end of the post member;

c. a fixed length purlin clip having a first portion rotatably connectable to the other end of the post member and a second portion attachable to the new roof structure said purlin clip available in a plurality of predetermined lengths; and d. means for locking said purlin clip in position against the post member after the purlin clip has been rotated to the desired angle.

2. The subframing support assembly of claim 1 further comprising a sleeve member having openings at opposite ends thereof, each opening adapted to receive one end of a post member so that at least two post members can be joined together end-to-end to form a taller roof support member.

3. The subframing support assembly of claim 2 wherein said roof support member comprises at least two post members joined end to end by the sleeve member to create a roof support member having a desired height.

4. The subframing support assembly of claim 1 wherein said at least one post member has a first hole through a first end and a second hole through a second end, said first hole being spaced a first distance from an outer edge of the first end, said second hole being spaced a second distance from an outer edge of the second end.

5. The subframing support assembly of claim 4 wherein the first distance and the second distance are each one inch.

6. The subframing support assembly of claim 4 wherein the socket portion of the mounting member has at least one hole therethrough which is axially aligned with either of the first and second holes in the post member.

7. The subframing support assembly of claim 4 wherein each end of the sleeve member has at least one hole therethrough, each said hole located to axially align with either of the first and second holes in the post member.

8. The subframing support assembly of claim 1 wherein the base plate portion of the mounting member has at least one aperture therethrough for attachment to the existing roof.

9. The subframing support assembly of claim 1 wherein the means for locking comprises at least one aperture spaced from an axis about which the purlin clip rotates and through such aperture a fastener can be installed to lock the purlin clip at the desired angle.

10. A subframing support assembly kit for reroofing an existing roof by connecting a new roof structure over the existing roof wherein the new roof has a slope independent of the slope of the existing roof, said subframing support assembly kit comprising:

a. a plurality of post members each having a fixed length, selected ones of said plurality of post members available in different fixed lengths;

b. a plurality of purlin clips each having a first portion rotatably connectable to an end of a post member and a second portion attachable to the new roof structure, selected ones of said plurality of purlin clips available in different fixed lengths said first portion having provision for locking said purlin clips to said post member at a desired angle; and c. a plurality of mounting members each having a base plate portion mountable to the existing roof and a socket portion adapted to connect to an end of a post member.

11. The subframing support assembly kit of claim 10 further comprising at least one hollow sleeve member having an opening at opposite ends thereof, each said opening adapted to receive therein an end of a post member such that at least two post members can be connected end-to-end to form a taller post member.

12. The subframing support assembly kit of claim 11 further comprising:

each post member having at least one hole through each end thereof;

each purlin clip having at least one hole in the first portion to align with the at least one hole in each end of the post member;

the socket portion of each mounting member having at least one hole therethrough to align with the at least one hole in each end of the post member; and each sleeve member having at least one hole through each end transverse to the opening to align with the at least one hole in each end of the post member.

13. The subframing support assembly kit of claim 12 wherein said provision for locking the purlin clips comprises the first portion of the purlin clips further having at least one offset hole therein spaced apart from said at least one hole and through which said at least one offset hole a fastener can be inserted to lock the purlin clip at the desired angle.

* * * * *